US005312033A

United States Patent [19]

Walton et al.

[11] Patent Number: 5,312,033

[45] Date of Patent: May 17, 1994

[54] WEB CONVEYOR DRIVE SYSTEM

[75] Inventors: Robert L. Walton, Fairport; Alfred Gooray, Rochester, both of N.Y.

[73] Assignee: Eastman Kodak Company, Rochester, N.Y.

[21] Appl. No.: 774,680

[22] Filed: Oct. 11, 1991

[51] Int. Cl.[5] ..... B65H 23/20; H02P 5/00

[52] U.S. Cl. ..... 226/108; 318/85; 101/248; 226/112; 226/188; 226/30; 226/27

[58] Field of Search ..... 226/108, 111, 112, 188, 226/189, 95, 24, 30, 31, 29, 27; 242/75.51; 101/248; 318/7, 85

[56] References Cited

U.S. PATENT DOCUMENTS 3,364,404 1/1968 Carlson ..... 318/7
3,412,915 11/1968 Hertrich ..... 226/95 X
3,549,004 12/1970 Zysman ..... 226/95 X
3,675,098 7/1972 Heiberger ..... 318/85
3,694,634 9/1972 Horst et al. ..... 318/85 X
3,707,658 12/1972 Hilsenbeck ..... 318/7
3,828,168 8/1974 O'Callaghan et al. ..... 318/85 X
3,949,282 4/1976 Coberley ..... 318/85
4,061,947 12/1977 Vogel ..... 318/7 X
4,344,552 8/1982 Gret ..... 226/95
4,408,281 10/1983 Tack, Jr. et al. ..... 318/85 X
4,435,883 3/1984 Muszynski ..... 318/7 X
4,497,788 5/1984 Mundt et al. ..... 318/85 X
4,891,566 1/1990 Sturwald et al. ..... 318/85 X

*Primary Examiner*—Daniel P. Stodola
*Assistant Examiner*—Paul T. Bowen
*Attorney, Agent, or Firm*—Clyde E. Bailey

[57] ABSTRACT

A web conveyor drive system, for example of the suction box type, employs independent motor drives for each of the plurality of drive rollers in the suction drive. Web tension drive loads are equalized across the drive rollers by controlling the individual motor drive current to a value substantially equal to the average of all the motor drive currents in the conveyor drive.

3 Claims, 3 Drawing Sheets

WEB CONVEYOR DRIVE SYSTEM

FIELD OF INVENTION

The invention relates to the field of web conveyor drive systems and is of particular interest to "suction box" type drive systems in which drive rollers contact only one surface of the web.

BACKGROUND

A typical web conveyance drive in a web section where contact is possible with only one face of the web consists of a plurality of adjacent, parallel in-line drive rollers nested in a suction box with the web held to the rollers by reduced air pressure created in the suction box. In one prior known web conveyance drive of this type, the rollers have been driven and synchronized together by chains or belts from a single motor. While this arrangement assures that all rollers in the drive rotate at the same angular speed, it has several operational problems. The belts or chains have a tendency to generate dirt which can contaminate the web product. They are also subject to wear and mechanical failure and are a source of machine failure from time to time. Moreover, assuring that all of the rollers rotate at the same angular speed does not assure that the rollers will have the same surface speed required for proper operation of the web drive. In order to assure adequate control over roller surface speed, it is necessary to precision machine special rollers to very tight diameter specifications. This requires special manufacturing and stocking procedures and prohibits the use of refinished rollers.

A known alternative to chain or belt synchronized drives is to drive the rollers individually, one motor per roller, with the rotation of the rollers held together by "electronic synchronization" provided by AC motors driven by a variable-frequency drive or servo motors held to relative position by position feedback. The controlled AC motors drive arrangement provides adequate load sharing between the motors but results in speed control with inadequate frequency response. Such response typically results in stability difficulties in tuning the tension/position loop associated with the drive, which means the tension/position loops gains are too low to adequately control web tension or the amount of web in the controlled web span.

Although the alternative of using positioning servo motor drives is effective to lock the angular position of each roller to the others, it requires the same precise control over roller diameters as in the belt/chain synchronizing approach. It is, of course, possible to compensate for roller diameter variations through fine electronic adjustment of the ratios of the speed of the various rollers, however, such an arrangement requires complicated and expensive control circuitry and sensing equipment (encoders, pulse rate multipliers, etc.) that add substantially to the cost of the drive system. It also requires that the controls be carefully recalibrated every time a roller is replaced.

Another known approach to web drive roller synchronization involves "current compounding" of the drive motor currents. In this approach, a signal proportional to motor current is subtracted from the speed reference applied to each drive motor which causes the motors with the highest currents to have the most speed subtracted from their speed references. In practice however, this approach has been found to be impractical because loop gains sufficient to actually level motor currents in the face of typical tachometer errors cause control system instability. Another disadvantage is that an increased load on the suction box drive (for example, higher web tension at the suction box inlet) causes a net decrease in the actual speed of the box. This speed change would require compensation by an external position loop controller. It also would prevent the use of such a suction box as a machine master for the conveyor system, since its speed would vary with load.

It is therefore an object of the present invention to provide a web conveyor drive system of the type described that maintains roller speed synchronization without the use of belts or chains and without the use of complicated and costly electronically controlled servo positioning drives.

It is a further object of the invention to provide such a web conveyor drive that maintains substantially equal surface speeds among the rollers despite significant differences in roller diameters thus allowing the use of less costly rollers and facilitating the maintenance considerations.

It is a still further object of the invention to provide such a web conveyor that maintains a relatively constant web speed in the face of variations in input tension thus allowing use of the web drive as a machine master drive system.

SUMMARY OF THE INVENTION

In carrying out the foregoing objects, a web conveyor drive system of the present invention comprises roller drive apparatus having a plurality of web drive rollers adapted to drive an elongated web by contact with only one surface of the web. The roller drive apparatus is further provided with an independent motor drive coupled to each of the drive rollers, each of the motor drives including means for supplying an output signal representative of its respective motor drive current. The web conveyor drive system also comprises means for supplying a linespeed reference signal for the web being driven by the roller drive apparatus.

According to a feature of the invention, the conveyor drive system further includes current leveling means responsive to the linespeed reference signal and to the motor drive current representative signal from each of the motor drives for maintaining drive current in each motor drive substantially equal to an average value of all of the motor drive currents.

In a particularly preferred form of the invention, the current leveling means is comprised of signal averaging means responsive to all of the motor drive current signals for generating an average current signal representative of an average value of all of the motor drive current signals. The current leveling means further includes a plurality of first signal combining circuits individually responsive to the average current signal and to one of the motor drive current signals for generating difference error signals representative of the differences between the average current signal and each of the motor drive current signals. A plurality of signal controller means is provided wherein each controller includes a proportional control and an integral control for generating velocity error signals from each of said difference error signals. The current leveling means further includes a plurality of second signal combining circuits each of which are responsive to the linespeed reference signal and one of the velocity error signals for generating an independent velocity reference signal for each of said motor drives. Finally, means are provided for coupling the velocity reference signals to the motor drives to maintain each of the motor drive currents substantially equal to the average motor drive value.

DETAILED DESCRIPTION

Figure 1A:
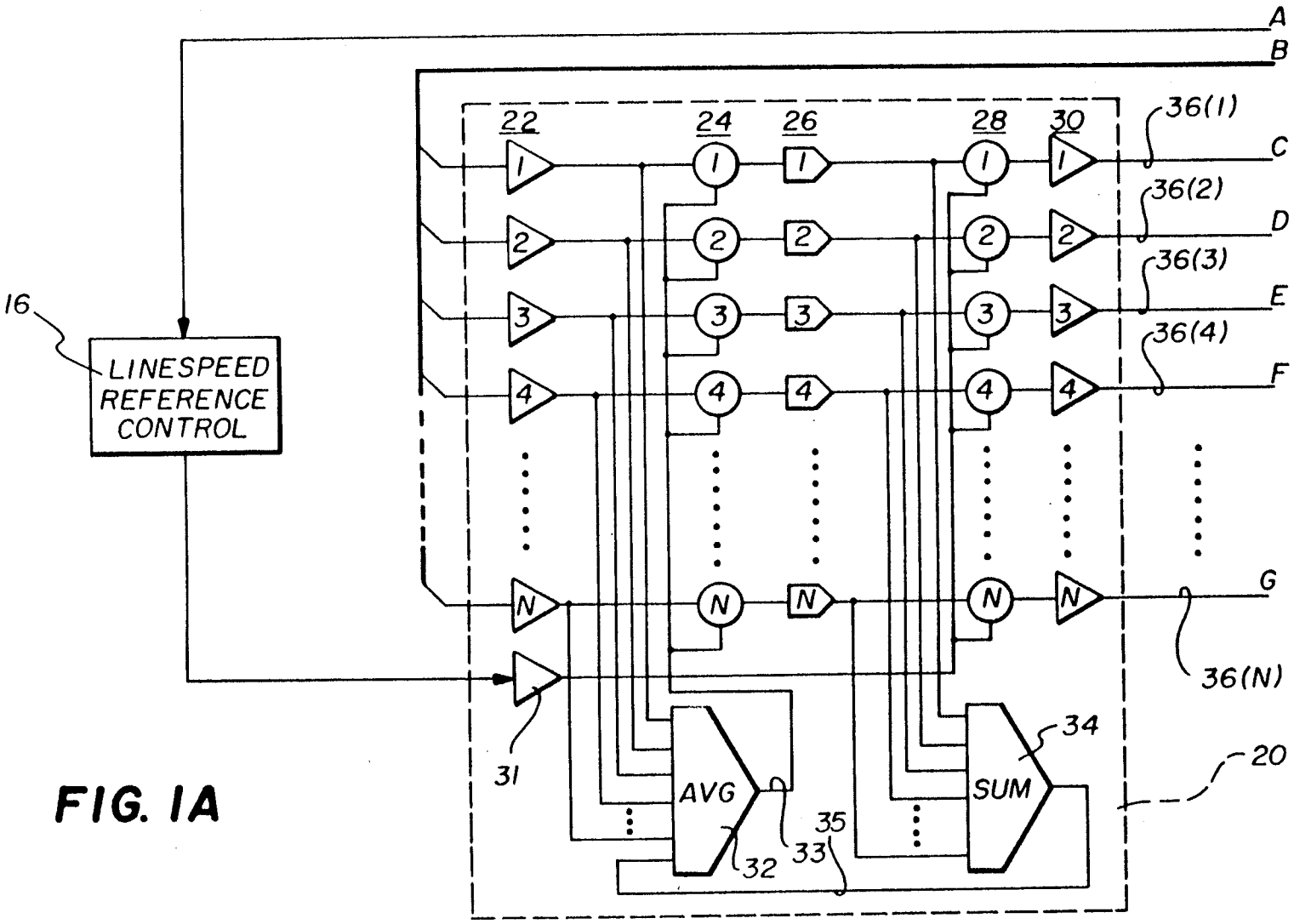
FIGS. 1A and 1B are a schematic block diagrams of a web conveyor drive system of the present invention.
Figure 1B:
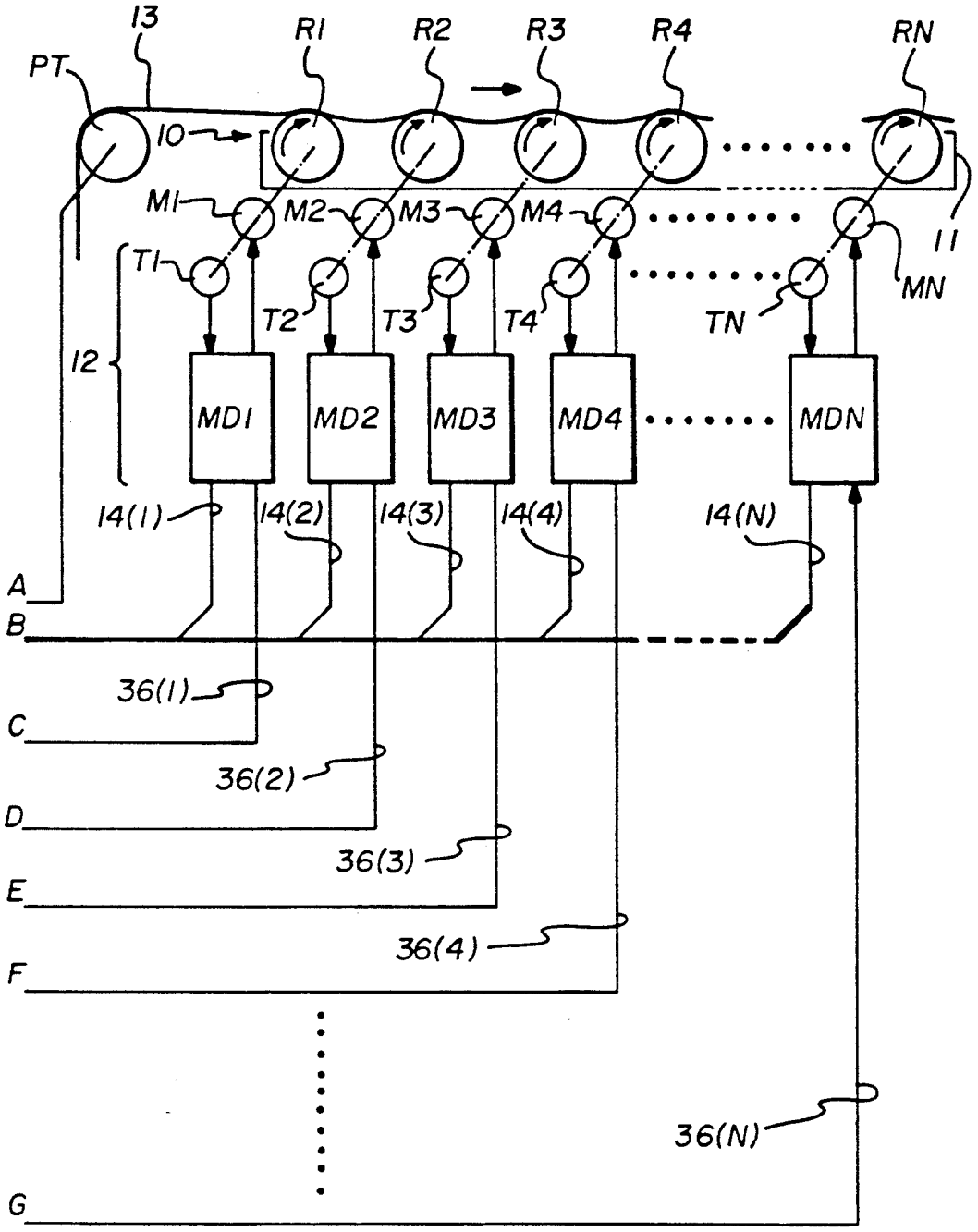
Figure 2:
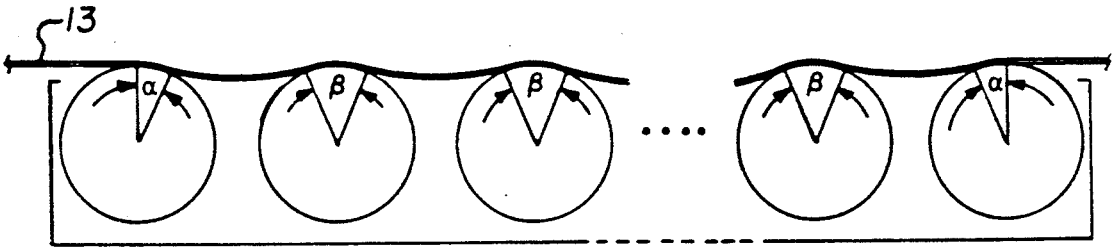
FIG. 2 is a side schematic view of a suction box web conveyor useful in the system of FIG. 1.

Referring now to FIGS. 1A and 1B, the web conveyor drive system shown therein is comprised of a roller drive apparatus indicated generally at 10 which includes a plurality of drive rollers, R1,R2,R3 . . . RN, nested in-line within a suction box 11. An elongated web 13, such as a web of photographic film or paper base material or other similar type of web material, passes over a position/tension control roller PT and over each of the drive rollers R1,R2,R3 . . . RN such that the drive rollers are in contact with only one surface of the web 13. Although not shown, it will be understood that suction box 11 includes an outlet attached to a vacuum pump to create a slight reduction in pressure within the box 11 which causes web 13 to be wrapped against the outer circumferences of the rollers as shown in FIG. 2. The rollers are independently driven by motors M1,M2,M3 . . . M(N) whose respective drive currents are controlled by motor drive circuits MD1,MD2,MD3 . . . MD(N). The motor and motor drive circuit combinations are individually provided with a tachometer T1,T2,T3, . . . T(N) to feed back motor speed signals which are compared with separate velocity reference input signals at the inputs of motor drives M1,M2,M3 . . . M(N) to maintain each motor at a desired rotational speed. Each of the motor drive circuits M1,M2,M3 . . . M(N) includes means for supplying on its corresponding output line 14 a signal representative of the motor drive current for its corresponding drive motor M.

Means including position/tension roller PT and linespeed reference control circuit 16 supplies a linespeed reference signal which is used to control the speed of web 13 to a predetermined reference speed established in control circuit 16 by the conveyor operator. This reference signal is supplied to an op-amp 31 in current leveling circuit 20.

In accordance with a feature of the invention, current leveling circuit 20 is responsive to the linespeed reference signal from control circuit 16 and individually to the motor drive current representative signals from each of the motor drive control circuits MD1,MD2,MD3 . . . MD(N) to maintain the drive current in each roller drive motor substantially equal to an average value of all of the drive currents of the roller motor drives M. To this end, the drive current representative signals from each of motor drive control circuits M1,M2,M3 . . . M(N) are applied via lines 14(1)–14(N) and op-amp inverter circuits 22(1)–22(N) to individual inputs of signal averaging circuit 32 which operates to generate an output signal on line 33 equal to the sum of the input current representative signals divided by the number of motors being controlled. This current average is then applied in common to first inputs of a plurality of signal combining circuits 24(1)–24(N) while the individual current representative signals are applied separately to second inputs thereof. Circuits 24(1)–24(N) are operative to generate output error signals representative of the difference between the average current signal and each of the motor drive representative signals.

These current difference error signals are then applied individually to a plurality of signal controller circuits 26(1)–26(N) having a transfer function that includes both a proportional control and an integral control to generate individual velocity error signals from each of the current difference error signals. More specifically, each of the controller circuits 26(1)–26(N) is provided with a transfer function which may be represented by the following expression:

$$V_{out}/V_{in}=K_p(1+K_i/s)$$

where:

$V_{out}$=voltage output of the circuit
$V_{in}$=voltage input of the circuit
$K_p$=proportional gain of the circuit
$K_i$=integral gain of the circuit
s=derivative operator The integral control serves to force the steady-state error of the circuit input signal "$V_{in}$" to zero and the proportional control serves to provide damping for the oscillatory behavior which would result if an integral-only controller were used.

These velocity error signals are then separately combined in signal combining circuits 28(1)–28(N) with the linespeed reference signal from op-amps 26(1)–26(N) to generate independent drive motor velocity reference signals which are then coupled via op-amps 30(1)–30(N) and lines 36(1)–36(N) to respective inputs of motor drive circuits MD(1)–MDN to maintain each of the motor drive currents substantially equal to the average value of all of the motor drive currents.

With the current leveling arrangement just described, the total drive load for the web conveyor system is shared equally among the motors M1,M2,M3 . . . M(N) used to drive the drive rollers R1,R2,R3 . . . R(N). Stated another way, all of the motors are caused to operate with the same drive current irrespective of changes in web speed or differences in individual roller web tension such as might be caused by variations in roller dimensions or individual tachometer errors that can typically occur.

It may be noted that it is possible with the foregoing current averaging arrangement to have the average motor speed of the suction box motors become offset in the long term from linespeed reference signal value input to the current leveling circuit from the linespeed reference control circuit 16. Such an adverse offset can be generated by the small errors inherent in electronic control circuits, such as variation in the resistance from nominal of resistors in analog control circuits or by roundoff typically employed in digital computer calculations. These small variations are manifest as slightly varying integral gains in the proportional/integral controller circuits 26(1)–26(N). To avoid this, it is desirable to drive the average of the velocity command offsets generated by controller circuits 26(1)–26(N) to a zero value. This is accomplished by applying each of the velocity error signals generated at the output of proportional/integral controller circuits 26(1)–26(N) to the input of a summing circuit 34 to generate a net velocity error signal which is then applied via line 35 to an additional input of averaging circuit 32.

Although not specifically shown FIG. 1, the selection of inverting versus non-inverting amplifiers and the resulting polarities of the signals in current leveling circuit 20 is a matter of design choice within the normal skill of the artisan to determine. For example, if it is assumed that the amplifiers 22 and 30 are non-inverting, the drive velocity references are considered to be positive in the direction of normal web motion and the motor current signals are considered to be positive in the direction of motoring, then the signal combining circuits 24(1)–24(N) would be differencing amplifiers with the negative inputs connected to the outputs of amplifiers 22 and circuits 28(1)–28(N) would be summing circuits. Given the convention as just described, summing circuit 34 would be an inverting circuit so that the summed output signal on line 35 applied to the input of averaging circuit 32 would be of opposite polarity to the remaining inputs to averaging circuit 32 applied from amplifiers 22.

Referring again to FIG. 2, it will be noted that web 13 is wrapped around a larger arc of the circumference of interior rollers R2,R3 . . . R(N-1), indicated by angle $\beta$ than in the case of the outermost end rollers R1 and R(N) as indicated by the smaller angle $\alpha$. For this reason, it is desirable to modify the motor drive current signals for the outermost rollers relative to the interior rollers to compensate for the different amount drive torque for the outermost rollers as compared to the interior rollers. For example, if the wrap angle $\alpha$ is one half the wrap angle $\beta$, the motor drive current representative signals applied to the input of differencing circuits 24(1)–24(N) for rollers R1 and R(N) would halved so as to modify the average current value accordingly.

It will be appreciated by those skilled in the art that what has been described is a novel web conveyor drive system particularly for drives that contact the web on only one surface which effectively utilizes unmodified, readily available motor drive components. It is capable of achieving controlled speed web drive operation without requiring costly, closely-toleranced roller diameters. Moreover the arrangement is tolerant of tachometer speed error, allowing for tachometer speed errors of several percent from one roller to the next without adverse effect on the overall drive control.

The invention has been described in detail with particular reference to a presently preferred embodiment, but it will be understood that variations and modifications can be effected within the spirit and scope of the invention.

What is claimed is:

1. A web conveyor drive system comprising:

roller drive apparatus having a plurality of web drive rollers adapted to drive an elongated web by contact with only one surface of the web and having an independent motor drive coupled to each of said drive rollers, each motor drive including means for supplying an output signal representative of its respective motor drive current;

means for supplying a linespeed reference signal for the web being driven by said drive apparatus;

signal averaging means responsive to all of said motor drive current signals for generating an average current signal representative of an average value of all of said motor drive current signals;

a plurality of first signal combining circuits individually responsive to said average current signal and to one of said motor drive current signals for generating difference error signals representative of the differences between said average current signal and each of said motor drive current signals;

a plurality of signal controller means each including a proportional control and an integral control for generating velocity error signals from each of said difference error signals;

a plurality of second signal combining circuits each responsive to said linespeed reference signal and one of said velocity error signals for generating an independent velocity reference signal for each of said motor drives;

and means for coupling said velocity reference signals to said motor drives to maintain each of said motor drive currents substantially equal to said average motor drive value.

2. The web conveyor drive system of claim 1, in which said web drive apparatus is comprised of at least three in-line drive rollers having outermost rollers at each end thereof and at least one interior roller therebetween, said rollers being nested in a suction box, said suction box being operative to hold a driven web against said at least one interior roller with a first amount of wrap around each interior roller circumference and against the outermost rollers with a second amount of wrap around each of the outermost rollers as compared to said at least one interior roller.

3. The web conveyor drive system of claim 1 or 2, further including means for summing said velocity error signals to generate a net velocity error signal and means for coupling said net velocity error signal to said signal averaging means.

* * * * *